US006361022B1

(12) United States Patent
Lob et al.

(10) Patent No.: US 6,361,022 B1
(45) Date of Patent: Mar. 26, 2002

(54) LIFTING DEVICE

(75) Inventors: Charles J Lob, Oconomowoc; John S Millman, Waukesha, both of WI (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 09/640,411

(22) Filed: Aug. 17, 2000

(51) Int. Cl.[7] ..... B66D 1/36

(52) U.S. Cl. ..... 254/338; 254/394; 294/74; 114/44; 414/626; 248/328

(58) Field of Search ..... 254/334, 335, 254/338, 388, 389, 390, 391, 394; 294/74, 67.4, 81.55; 114/44, 46, 51; 414/626; 248/327, 328

(56) References Cited

U.S. PATENT DOCUMENTS 741,583 A * 10/1903 Lawrence ..... 254/338
983,957 A * 2/1911 Trantham ..... 254/338
4,251,059 A * 2/1981 Fougea ..... 254/338
4,574,789 A * 3/1986 Forster ..... 254/401
4,600,177 A * 7/1986 Fritz ..... 254/338
5,037,237 A * 8/1991 Anteau ..... 294/74
5,051,027 A * 9/1991 Horton ..... 254/338
5,297,832 A * 3/1994 Dewey et al. ..... 294/67.4
5,897,104 A * 4/1999 Garbiso ..... 254/334
5,984,275 A * 11/1999 Hoslett ..... 254/338
6,056,274 A * 5/2000 Naas et al. ..... 254/394
6,152,427 A * 11/2000 Hoslett ..... 254/338

* cited by examiner

*Primary Examiner*—Emmanuel M. Marcelo
(74) *Attorney, Agent, or Firm*—Pyle & Piontek

(57) ABSTRACT

A lifting device for lifting elongate objects such as watercraft from trailers or the like to overhead storage positions has a plurality of individual lines passing over a plurality of pulleys generally configured in a rectangular shape and supported from an overhead support such as a ceiling. First ends of each of the individual lines are attached to slings underlying the watercraft. Second ends of the individual lines pass through gathering means along a longitudinal axis. A multiple purchase block and tackle system also runs along the longitudinal axis, and has first and second ends attached by a hauling line. The individual lines each have second ends attached to the first end of the block and tackle system, so that as the block and tackle first end is moved each of the individual lines is moved simultaneously and an equal distance. Uniform, mechanically advantageous lifting of the watercraft is thereby achieved by manipulation of a single hauling line.

18 Claims, 4 Drawing Sheets

LIFTING DEVICE

FIELD OF THE INVENTION

The present invention relates to lifting devices. More particularly, the present invention relates to an apparatus suspended from an overhead support for lifting an object, especially an elongated object such as a watercraft.

BACKGROUND OF THE INVENTION

Many types of objects are carried about on trailers or on the tops of motor vehicles, including watercraft. As an example, the owner of a boat may reside some distance from a water body, and not have access to watercraft storage at the body of water. The boat owner may store his boat at his home in a garage, and carry the boat on his automobile roof or on a trailer from the garage to the body of water for use. For storage, the boat must be removed from the automobile or trailer and transferred to a storage position. Many types of boats are sufficiently heavy as to make transfer from the automobile or trailer a difficult or even impossible task for a single individual.

Lifting devices for such purposes are known in the prior art. These devices as presently known, however, leave many problems unresolved.

As an example, some prior art lifting devices do not utilize a single haul line. Because of the size and shape of generally elongate objects such as watercraft, multiple support points on the object may be required for raising and lowering. For example, a watercraft may require a support to be placed under it near its stern and a second under it near its bow. These supports must generally be raised or lowered substantially simultaneously. Operation of such devices thus requires one person per support, thereby making operation by a single individual impractical or impossible. Solutions to multiple lifting points requiring multiple individuals have been proposed. These solutions, however, have heretofore been overly complicated and costly.

Other lifting devices of the prior art are not suitable to lift objects of substantial weight. These devices generally comprise ropes attached to the object and directed through pulleys to a lifting location. Minimal mechanical advantage is provided, however, so that objects of substantial weight, such as a jet ski or small motor boat cannot be lifted by an individual. Lifting devices have been proposed that provide mechanical advantages through cranks, winches, and the like. These devices, however, tend to be overly complicated and expensive, making them impractical and disadvantageous.

An unresolved need therefore exits for a lifting device suitable for use by a single individual and capable of lifting objects of substantial weight.

OBJECTS OF THE INVENTION

It is an object of the invention to provide a lifting device for lifting an object.

It is a further object of the invention to provide a lifting device having a mechanical advantage and suitable for lifting a water craft through manipulation of a single line.

SUMMARY OF THE INVENTION

The present invention comprises a lifting device for raising and lowering an elongate object into a storage position, the lifting device comprising at least a first and a second pair of pulleys, the first and second pairs of pulleys being spaced from one another along a longitudinal axis, each individual pulley of said first and second pair of pulleys spaced laterally from the longitudinal axis, with the first and second pair of pulleys connected to an upright support. Individual lines pass over each individual of the pairs of pulleys, each of the individual lines have means for attachment to the elongate object, and each of the individual lines further comprise second ends.

The lifting device further comprises a multiple purchase block and tackle system spaced from one of the pairs of pulleys along the longitudinal axis. The multiple purchase block and tackle system comprises a first and a second end, and an adjustable hauling line reeved between the ends for moving the ends towards one another with multiple purchase. The block and tackle system first end is connected to each of the second ends of the individual lines, and the block and tackle system second end is attached to an upright support such as a garage wall. Hauling on the hauling line thereby urges block and tackle system first end towards the second end along the longitudinal axis, further causing simultaneous movement of the individual lines for raising and lowering the elongate object.

The present invention thereby presents an apparatus that offers substantial mechanical advantage through the block and tackle system for raising and lowering of objects. Further, because the individual lines are connected to one end of the block and tackle system, the object may be raised or lowered through the manipulation of the haul line only.

Preferably, the lifting device further comprises gathering means for gathering and leading the individual lines substantially along the longitudinal axis. Most preferably, the gathering means comprise at least a pair of rotating pulleys. By gathering the individual lines substantially along the longitudinal axis, they may move a substantially equal distance along the axis when the hauling line is hauled to move the ends of the multiple purchase system towards or away from one another. This results in the object being lifted a substantially equal amount by each of the individual lines, for a smooth and level raising.

The lifting device of the present invention thus comprises a relatively simple to construct, low cost, and easy to install device. Through the multiple purchase block and tackle system the device provides means for lifting objects of substantial weight and size by a single individual through manipulation of a single hauling line. Further, with the preferred gathering means, each of the individual lines may be drawn an equal amount by the block and tackle system so that the object is uniformly raised and lowered by the multiple lines through manipulation of the single haul line. The present invention thus solves several heretofore unresolved problems in an efficient and elegant manner.

DETAILED DESCRIPTION

Figure 1:
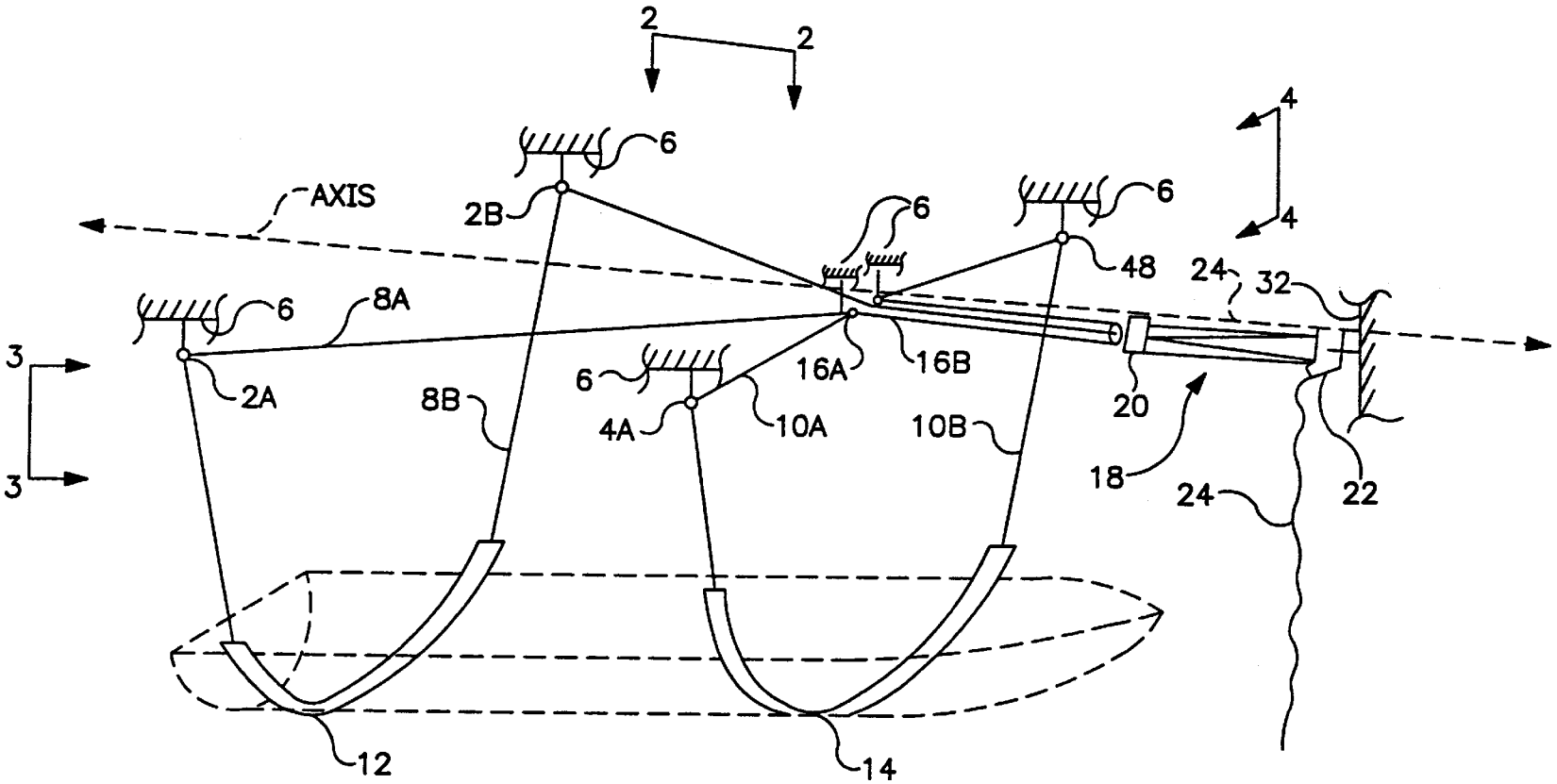
FIG. 1 is a perspective view of an embodiment of the lifting device of the present invention engaging a boat (shown in dashed line).
Figure 2:
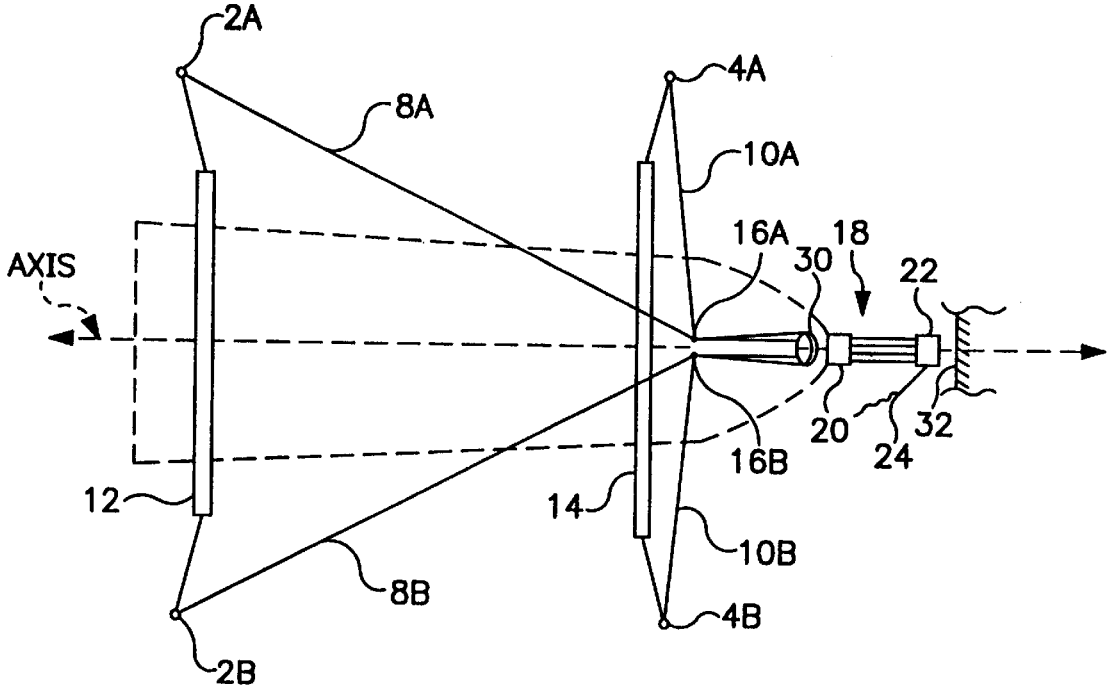
FIG. 2 is a top plan view of the embodiment of the lifting device of the invention illustrated in FIG. 1 along the line 2—2 of FIG. 1.
Figure 3:
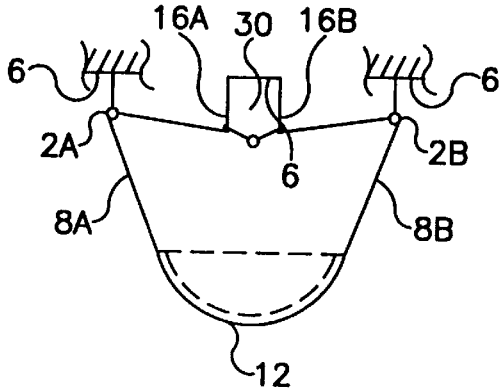
FIG. 3 is an elevational view of the embodiment of the lifting device of the invention illustrated in FIG. 1 along the line 3—3 of FIG. 1.
Figure 4:
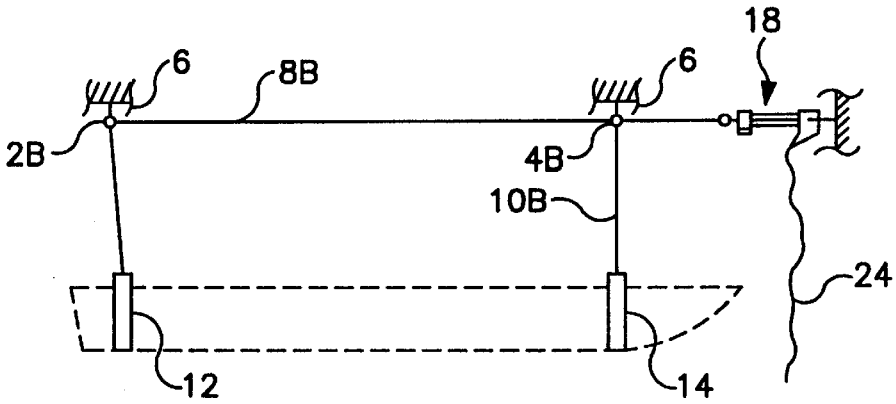
FIG. 4 is an elevational view of the embodiment of the lifting device of the invention illustrated in FIG. 1 along the line 4—4 of FIG. 1.

In order to better illustrate the lifting device, reference is now made to the drawings. FIGS. 1–4 provide various views of the preferred embodiment of the lifting device of the present invention in use to support a watercraft (shown in dashed line). In particular, FIG. 1 is a perspective view of the preferred lifting device, FIG. 2 is a top plan view, FIG. 3 is an elevational view, and FIG. 4 is an elevational view of the preferred device. In the following description of the preferred device, reference will be made to common elements as illustrated in FIGS. 1–4.

The lifting device as illustrated comprises a first pair of pulleys 2A and 2B, and a second pair of pulleys 4A and 4B. Pulleys 2A–B and 4A–B are spaced from one another along a longitudinal axis illustrated as a dashed line and labeled AXIS in FIG. 1, which passes generally along the center plane between respective pulleys 2A–B and 4A–B. Individual pulleys 2A, 2B, 4A, and 4B are thus spaced laterally from AXIS. AXIS is preferably substantially parallel to a center longitudinal axis of the boat being lifted. Each individual pulley 2A–B and 4A–B are attached to an upright support 6. Support 6 may comprise, by way of example, a garage or other structure roof, a frame member that is attached to a garage or other roof, or any other suitable upright support. Individual lines 8A, 8B, 10A, and 10B movably pass over respective pulleys 2A, 2B, 4A, and 4B. Each individual line 8A–B and 10A–B have means for attachment to the boat.

As illustrated in FIG. 1, preferred attachment means comprise slings 12 and 14, with sling 12 connected to first ends of individual lines 8A and 8B; and sling 14 connected to first ends of individual lines 10A and 10B. Preferred slings 12 and 14 are substantially flat for enhanced surface area and resultantly good support characteristics under the boat. Preferred slings 12 and 14 also comprise anti-slip surfaces for enhanced gripping power on smooth surfaced objects being lifted, such as fiberglass boats. Preferred slings may also comprise contact surfaces that will not mark or otherwise damage such smooth object surfaces. As will also be appreciated by those knowledgeable in the art, the lifting device of the invention may of course be practiced using means other than preferred slings 12 and 14. By way of example and not limitation, other means may comprise connectors on respective individual line ends for connection to cooperating connectors on the boat, or means comprising underlying supports in a shape different than the substantially flat slings illustrated. Also, a single web or net structure may be connected to each of the first ends of the individual lines to underlie and support the object. Further, means may comprise lengths of rope connecting the ends of opposing individual lines, so that individual lines 8A–B and 10A–B become continuous lengths of rope.

The preferred lifting device of the present invention further comprises gathering means 16 for organizing the individual lengths of rope 8A–B and 10A–B in a direction substantially along the AXIS. Preferred gathering means 16 comprise at least a pair of pulleys 16A and 16B. Additional pulleys may be comprised, but it has been discovered that preferred pair 16A and 16B provide a convenient and cost effective gathering means. If more than two pairs of pulleys 2A–B and 4A–B are comprised, it may be desirable to utilize additional gathering pulleys for orderly organization of the individual lines. Further, it has been discovered that placement of preferred pulleys 16A and 16B transverse from and a short distance from longitudinal AXIS, and inward from pulleys 4A and 4B is advantageous. Gathering pulleys 16A–B are preferably attached to overhead support 6.

Figure 5:
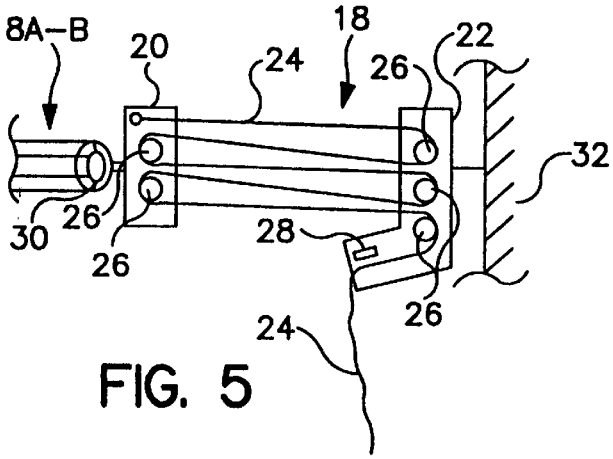
FIG. 5 is an illustration of an embodiment of the multiple purchase block and tackle system of the invention.

The preferred lifting device further comprises a multiple purchase block and tackle system 18. System 18 comprises first end 20 and second end 22, through which hauling line 24 is reeved. System 18 runs substantially along longitudinal AXIS, and is spaced from pulley pair 4. As best illustrated in FIG. 5, each system end 20 and 22 comprises a plurality of rotating members 26 around which hauling line 24 is reeved. A first end of hauling line 24 is fixably attached to one of system ends 20 or 22 (illustrated as attached to first end 20), with a, second end 30 passing through lockable cleat 28 and hanging below second end 22 for adjustment. System second end 22 is fixably attached to upright support 32, which may comprise by way of example a garage wall. As illustrated, lockable cleat 28 is preferably attached to system second end 22, but may of course likewise be attached to support 32 or be placed at any other suitable location.

Block and tackle system 18 comprises a purchase ratio of at least 2:1, and preferably 4:1. It has been discovered that 4:1 purchase strikes an advantageous balance between simple, cost effective construction and useful mechanical advantage for raising and lowering watercraft of trailerable dimensions. Greater or lower purchase ratios may of course be comprised to accommodate raising and lowering objects of different weights.

Figure 6:
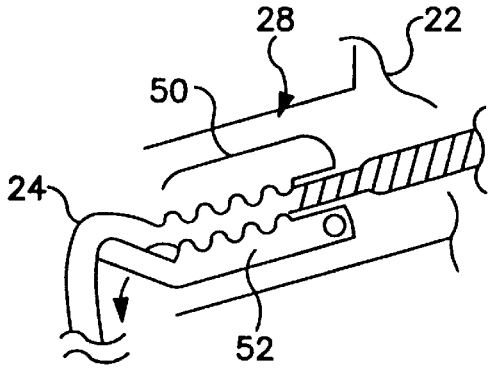
FIG. 6 is an illustration of an embodiment of the cleat of the multiple purchase block and tackle system of the invention.

As best illustrated in FIG. 6, preferred cleat 28 comprises a cam, with locking surface 50 and cooperating spring loaded pawl arm 52. Hauling line 24 passes between pawl arm 52 and locking surface 50, with spring loaded arm 52 urging pawl arm 52 into a locked position. Pulling on hauling line 24 urges pawl arm 52 into an open position as indicated by the arrow in FIG. 6 for adjustment of line 24. The dog-legged upward bend of pawl arm 52 allows for convenient adjustment of haul line 24 when line 24 is hauled on from below. In addition to preferred cam 28, other cleat means may of course be comprised within the device of the present invention and the scope of the attached claims that will allow for adjustable hauling of line 24 with locking of the line upon release.

Referring once again to FIGS. 1–4 and to FIG. 5 in particular, individual lines 8A–B and 10A–B are connected to block and tackle system first end 20. A user's hauling downwards on hauling line 24 causes preferred cleat 28 pawl arm 52 to move into an open position, after which hauling line may be tightened or loosened. Tightening of hauling line 24 will cause block and tackle system first end 20 to move towards second end 22 with multiple purchase, while loosening of hauling line 24 will cause end 20 to move away from end 22.

Individual lines 8A–B and 10A–B have second ends attached to block and tackle system first end 20. As best illustrated in FIG. 5, the respective individual lines may be attached by means of connector ring 30 to which each of the respective ends are tied or otherwise tethered. Movement of system first end 20 thereby causes movement of each of individual lines 8A–B and 10A–B. Because the individual lines have been organized by gathering means 16 substantially along the longitudinal AXIS, movement of block and tackle system first end 20 forward and back along AXIS causes movement of each respective individual line a substantially equal distance. This is an important advantage of the lifting device of the present invention as it allows for raising of all portions of the boat an equal simultaneous amount through manipulation of the single hauling line 24.

As generally illustrated in FIGS. 1–4, pulley pairs 2A–B and 4A–B are preferably spaced in an approximate rectangular fashion. It has been discovered that such a configuration is advantageous for lifting elongate objects such as watercraft. It is noted that although reference to lifting of watercraft is made herein and in the Figs., the lifting device of the present invention is suitable for lifting of a wide variety of objects. By way of example, the lifting device of the invention may be employed to lift convertible hardtops, pickup truck bed covers, motorcycles, and other objects.

Further, as will be appreciated by those knowledgeable in the art, the lifting device of the present invention and as claimed in the attached claims may take configurations other than that as illustrated in FIGS. 1–4. By way of example and not limitation, reference is made to the top plan view of FIG. 7 of an alternate lifting device configuration. Three pulley pairs 100A–B, 101A–B, and 102A–B pass individual lines 106–112 to gathering pulleys 104A–B, which are not equally spaced laterally between pulley pairs 100–102, and 102, and which are not spaced laterally between either pulley pairs 100–102. Pulley pairs 100–102 are not located along the same longitudinal axis, as may be useful for example to accommodate boats of objects of a particular shape. Individual lines 106–112, which are of different lengths, are gathered by gathering pulleys 104 and arranged along longitudinal AXIS, which is not equally spaced between pulleys.

Figure 7:
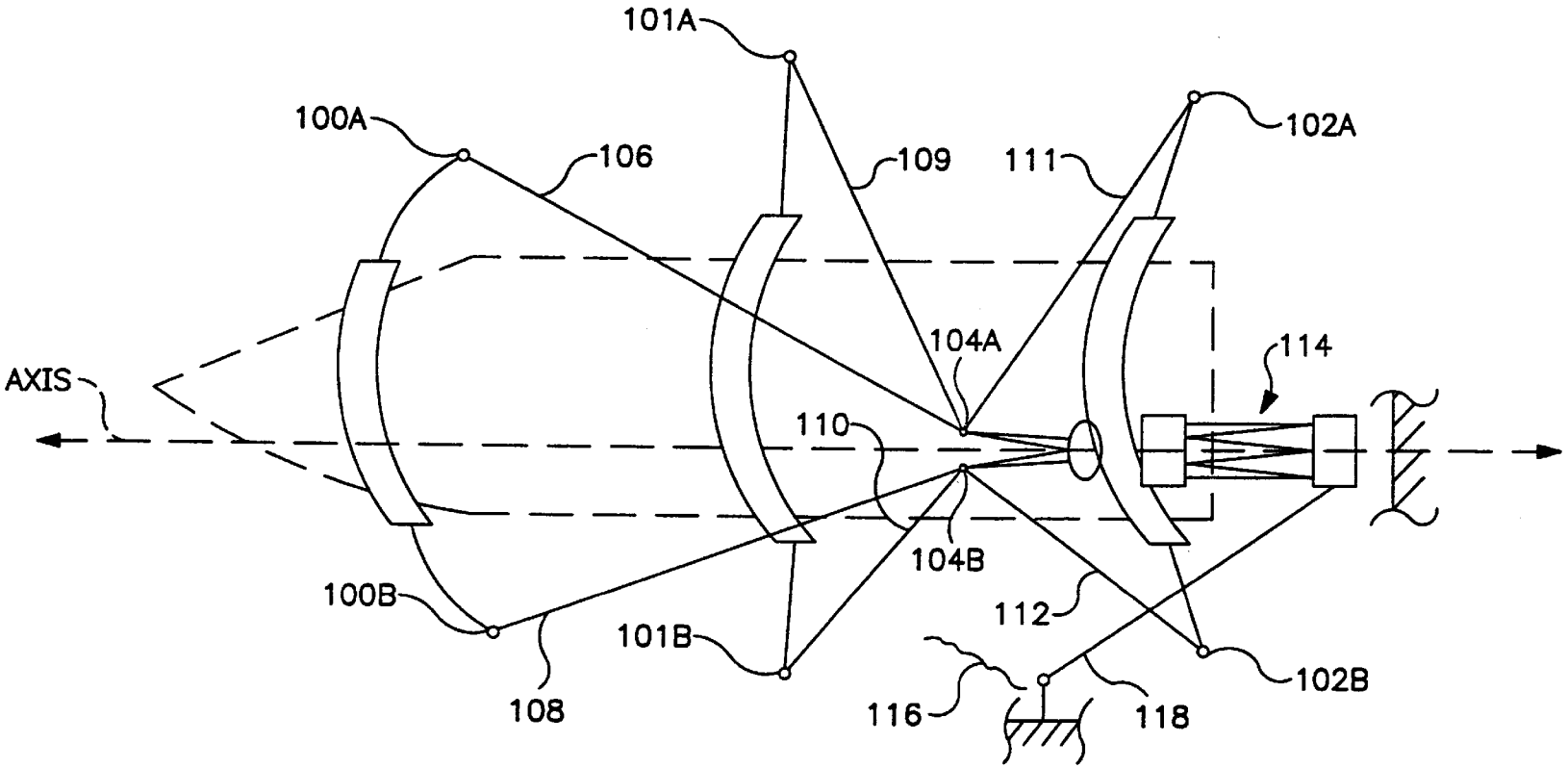
FIG. 7 is a top plan view of an alternate lifting device configuration of the invention.

Block and tackle system 114 operates along AXIS, so that individual lines 106–112 passing through gathering pulleys 104A–B are moved an equal distance when block and tackle system 114 is operated. FIG. 7 also illustrates hauling line 116 passing from block and tackle system 114 to remotely mounted cam cleat 118 for adjustment at a position along the side of the boat being lifted. The lifting device as configured in FIG. 7 operates in the same general manner as that discussed above with reference to FIGS. 1–4, and with the same advantageous result. The lifting device configuration as illustrated in FIG. 7 may be of utility, for instance, to fit a garage having dimensions not allowing for the configuration as illustrated in FIGS. 1–4.

It is further noted that longitudinal AXIS need not travel in any particular direction. As an example, longitudinal AXIS may run in a direction substantially perpendicular to the longitudinal axis of the watercraft.

The advantages of the disclosed invention are thus attained in an economical, practical, and facile manner. While example embodiments have been shown and described, it is to be understood that various further modifications and additional configurations will be apparent to those skilled in the art. It is intended that the specific embodiments herein disclosed are illustrative of the preferred and best modes for practicing the invention only, and should not be interpreted as limitations on the scope of the invention as defined by the appended claims.

What is claimed is:

1. A lifting device for raising and lowering an elongate object into a storage position, the elongate object having a first longitudinal axis; the lifting device comprising:

a) at least a first and a second pair of pulleys, said first and second pairs of pulleys being spaced from one another along a second longitudinal axis, each individual pulley of said first and second pair of pulleys spaced laterally from said second longitudinal axis, each of said first and second pair of pulleys connected to an upright support;

b) individual lines passing over each individual of said pairs of pulleys, each of said individual lines having means for attachment to the elongate object, each of said individual lines having second ends; and c) a multiple purchase block and tackle system spaced from one of said pairs of pulleys along said second longitudinal axis, said multiple purchase block and tackle system comprising a first and a second end, an adjustable hauling line means reeved between said block and tackle first and second ends for moving said block and tackle system ends towards one another with multiple purchase, said block and tackle system first end connected to said second ends of said individual lines, said block and tackle second end attached to an upright support, whereby hauling on said hauling line causes said block and tackle first end to move towards said block and tackle system second end and said individual lines are thereby simultaneously moved.

2. A lifting device as in claim 1, wherein the lifting device further comprises means for gathering and leading said individual lines substantially along said second longitudinal axis, whereby said individual lines second ends attached to said block and tackle system first end will be moved by said block and tackle system first end substantially along said second longitudinal axis.

3. A lifting device as in, claim 2, wherein said means for gathering and leading said second ends of said individual lines comprises at least a pair of rotating members spaced inwardly from one of said first and second pairs of pulleys.

4. A lifting device as in claim 3, wherein said at least a pair of rotating members comprise a pair of spaced pulleys.

5. A lifting device as in claim 3, wherein said rotating members are located transverse to said longitudinal axis.

6. A lifting device as in claim 5, wherein said rotating members are secured on said upright support centrally between one of said first or second pairs of pulleys.

7. A lifting device as in claim 1, wherein said means for attaching the elongate object at said first ends of said individual lines comprises a sling passing beneath the elongate object for supporting the object, said sling travelling substantially transverse to the elongate object first longitudinal axis.

8. A lifting device as in claim 1, additionally comprising means for securing and releasing said hauling line means.

9. A lifting device as in claim 8 wherein said means comprise a cleat.

10. A lifting device as in claim 8, wherein said cleat comprises a cam cleat.

11. A lifting device as in claim 10, wherein said cam cleat is connected to said block and tackle system second end, said cam cleat further comprising a locking surface and a cooperating spring loaded pawl arm, said spring loaded pawl arm positioned below said locking member with said hauling line passing therebetween, whereby said spring loaded pawl arm urges said hauling line into a locked position when said hauling line hangs free, and whereby hauling on said hauling line urges said spring loaded pawl into an open unlocked position whereby said hauling line may be adjusted.

12. A lifting device as in claim 1, wherein said at least two pairs of pulleys are arranged in a substantially rectangular position.

13. A lifting device as in claim 1, wherein said at least two pairs of pulleys are equally spaced from said second longitudinal axis.

14. A lifting device as in claim 1, wherein said second longitudinal axis is substantially parallel to the first longitudinal axis.

15. A lifting device as in claim 1, wherein hauling on said hauling line causes simultaneous movement of each of said individual lines, each of said individual lines moving a substantially equal distance along said longitudinal axis.

16. A lifting device as in claim 1, wherein said multiple purchase block and tackle system comprises a 4:1 purchase ratio.

17. A lifting device for raising and lowering a watercraft into a storage position in a building, said building having a ceiling and a wall, the watercraft having a first longitudinal axis; the device comprising:

a) at least a first and a second pair of pulleys, said first and second pairs of pulleys being spaced from one another along a second longitudinal axis, each individual pulley of said first and second pair of pulleys spaced laterally from said longitudinal axis, said first and second pair of pulleys connected to the ceiling;

b) individual lines passing over each individual of said pairs of pulleys, each of said individual lines having first ends connected to substantially flat slings, said substantially flat slings underlying and supporting the elongate object, said slings passing under the object substantially transverse to the object first longitudinal axis; each of said individual lines having second ends;

c) at least a pair of gathering pulleys located substantially along said second longitudinal axis between said first pair of pulleys, said at least a pair of gathering pulleys for gathering said individual lines along said second longitudinal axis; said gathering pulleys attached to the ceiling;

d) a multiple purchase block and tackle system spaced from said gathering pulleys along said second longitudinal axis, said multiple purchase block and tackle system comprising a first and a second end, an adjustable hauling line means reeved between said first and second ends for moving said first and second ends towards and away from one another with multiple purchase; said block and tackle second end fixably attached to the garage wall; said block and tackle system first end connected to said second ends of said individual lines, whereby hauling on said hauling line causes simultaneous movement of each of said individual lines a substantially equal distance for raising and lowering said object; said block and tackle second end further comprising releasable cleat means for locking said hauling line in place.

18. A lifting device as in claim 17, wherein said multiple purchase block and tackle system has a purchase ratio of 4:1.

* * * * *